US008631594B1

(12) United States Patent
Moyer

(10) Patent No.: US 8,631,594 B1
(45) Date of Patent: Jan. 21, 2014

(54) VARIABLE WIDTH SCREED ATTACHMENT

(71) Applicant: Sheldon Adam Moyer, Myerstown, PA (US)

(72) Inventor: Sheldon Adam Moyer, Myerstown, PA (US)

( * ) Notice: Subject to any disclaimer, the term of this patent is extended or adjusted under 35 U.S.C. 154(b) by 0 days.

(21) Appl. No.: 13/774,272

(22) Filed: Feb. 22, 2013

(51) Int. Cl.
*E02F 3/76* (2006.01)

(52) U.S. Cl.
USPC ..... 37/407; 37/361; 37/466

(58) Field of Classification Search
USPC ..... 404/118, 96; 37/403, 407, 466, 381
See application file for complete search history.

(56) References Cited

U.S. PATENT DOCUMENTS

| | | | | |
|---|---|---|---|---|
| 3,440,744 | A * | 4/1969 | Smith | 37/404 |
| 4,272,213 | A | 6/1981 | McGovarin | |
| 4,678,365 | A | 7/1987 | Ban et al. | |
| 4,936,392 | A | 6/1990 | Kitchin | |
| 5,190,401 | A * | 3/1993 | Wilson | 404/118 |
| 5,273,375 | A | 12/1993 | Plourde | |
| 5,701,693 | A * | 12/1997 | Brocious et al. | 37/381 |
| 6,582,152 | B2 | 6/2003 | Leone et al. | |
| 6,684,537 | B2 * | 2/2004 | Ichikawa et al. | 37/347 |
| 6,773,203 | B2 | 8/2004 | Casters | |
| 6,890,125 | B1 | 5/2005 | Calder et al. | |
| 6,922,925 | B2 * | 8/2005 | Watanabe et al. | 37/466 |
| 7,287,931 | B2 * | 10/2007 | Anibaldi et al. | 404/104 |
| 7,946,063 | B2 | 5/2011 | Paull | |
| 2005/0172527 | A1 * | 8/2005 | Mimuro et al. | 37/466 |
| 2005/0210718 | A1 * | 9/2005 | Ueda et al. | 37/466 |
| 2011/0085860 | A1 | 4/2011 | Gregerson | |

* cited by examiner

*Primary Examiner* — Thomas B Will
*Assistant Examiner* — Katherine Chu
(74) *Attorney, Agent, or Firm* — Hilary J. Sumner

(57) ABSTRACT

An improved variable width screed device that attaches to an industrial vehicle, such as an excavator, having a push blade and controlled arm mechanism. The position of the controlled arm mechanism determines the width of the screed. The screed width can be instantaneously adjusted along a spectrum of widths by modifying the radial position of the controlled arm mechanism.

12 Claims, 10 Drawing Sheets

VARIABLE WIDTH SCREED ATTACHMENT

CROSS-REFERENCE TO RELATED APPLICATIONS

Not Applicable

STATEMENT REGARDING FEDERALLY SPONSORED RESEARCH/DEVELOPMENT

Not Applicable

PARTIES TO A JOINT RESEARCH AGREEMENT

Not Applicable

REFERENCE TO SEQUENCE LISTING, TABLE OR COMPUTER PROGRAM

Not Applicable

BACKGROUND OF THE INVENTION

Prior Art

The following is a tabulation of the prior art revealed during a patent search that may be relevant:

| U.S. Pat. No./App. Number | Kind Code | Issue Date | Patentee |
|---|---|---|---|
| U.S. Pat. No. 4,272,213 | N/A | Jun. 9, 1981 | McGovarin |
| U.S. Pat. No. 4,678,365 | N/A | Jul. 7, 1987 | Ban et al. |
| U.S. Pat. No. 4,936,392 | N/A | Jun. 26,1990 | Kitchin |
| U.S. Pat. No. 5,273,375 | N/A | Dec. 28, 1993 | Plourde |
| U.S. Pat. No. 6,582,152 | B2 | Jun. 24, 2003 | Leone et al. |
| U.S. Pat. No. 6,773,203 | B2 | Aug. 10, 2004 | Casters |
| U.S. Pat. No. 6,890,125 | B1 | May 10, 2005 | Calder et al. |
| U.S. Pat. No. 7,287,931 | B2 | Oct. 30, 2007 | Anibaldi et al. |
| U.S. Pat. No. 7,946,063 | B2 | May 24, 2011 | Paull |
| US 2011/0085860 | A1 | Apr. 14, 2011 | Gregerson |

This invention relates generally to the leveling and grading of construction materials and deals more particularly with a variable width screed device attached to an industrial vehicle having a controlled arm mechanism and push blade.

It is often necessary to dig or cut a trench in preexisting pavement or earth in order to facilitate the installation or repair of underground utilities, structures, or systems. Typically once this repair or installation has been completed, the trench is backfilled with dirt, crushed stone, asphalt or other filling materials in order to stabilize and level the surface. This material is either manually raked or it is compacted and leveled using commercial road graders.

Manual raking and tamping are labor intensive and time-consuming, making commercial equipment a preferable method for surface grading. Known commercial graders are typically large, expensive, complex, and difficult to maneuver. A tremendous amount of time, money and manpower is expended in operating, maintaining, and transporting this equipment.

Commercial graders are generally intended for the leveling of wide spans of material. The immense weight of these machines supplies the required pressure to compress and smooth the grading area. Because this equipment is designed for a specific function, the commercial grader is of limited use on a jobsite. These single purpose machines can only be implemented for grading and oftentimes, they are not optimized for the leveling of narrower spans of material.

Multiple passes may be necessary to successfully level an excavated area. The large turning radius and subsequent lack of maneuverability of commercial grading equipment creates a significant disadvantage in leveling a surface quickly. Visibility in commercial grading machines is often an issue as well. Large components within these units obscure the work area, making it difficult for operators to gauge their progress. These machines must reposition themselves each time that an area requires rework, adding to the time and money expended in grading the area.

Smaller grading machines and screed devices that attach to industrial vehicles have been introduced. While these devices may improve maneuverability, inventor has found that these machines are very expensive, offer limited visibility, and have insufficient mass to effectively compress material in the grading area. The most significant disadvantage inherent in these attachments and their larger commercial counterparts is their inability or ineffective means for adjustment of the grading width.

Graders generally use a screed fitted with two opposing sidewalls to form a screed box. These sidewalls extend outward in a direction that is substantially perpendicular to the screed's longitudinal axis. The addition of these sidewalls helps to prevent material from flowing around the screed's edge.

Typically when a trench is backfilled, a large amount of filling material is placed into the excavated area. As the screed travels over the backfilled area, this material moves along and within the width of the screed box. If the screed box is wider than the trench, material will travel freely along the entire width of the screed box. As a result, excess material may be deposited along the edges of the trench with each pass of the grader. This results in wasted material and increased time and expense to level the trench edges.

Alternatively, if the screed box is narrower than the trench, excess material may spill over the top or sides of the screed box. This may also result in wasted material and increased time and expense to rework the overflow.

Many of the existing commercial grading machines and attachments do not allow the operator to adjust the width of the screed box. Those machines that do offer adjustable widths often require the operator to manually adjust the screed to a set width prior to grading. The operator typically bolts on or advances "extension screeds" by hand. These extendable screeds generally offer fixed or pre-set widths rather than variable grading widths.

The problem with these devices is that they offer limited extension widths and require the interruption of the grading process. If the grading width has not been appropriately fixed, the operation must be suspended while the operator readjusts this width, using independent controls or mechanical means to extend or retract the screeds. This process is repeated until a workable width has been achieved. This is a time consuming practice and one that adds to the overall resources expended in grading the area.

There is therefore a need in the art for an inexpensive, easily maneuverable screed that attaches to a multi-purpose industrial vehicle offering variable width adjustment of the screed box, improved visibility, and sufficient compression to successfully grade the work area.

BRIEF SUMMARY OF THE INVENTION

The present invention addresses the problems discussed above by offering a screed attachment with a variably and instantaneously adjustable grading width. The device is designed to attach to an industrial vehicle, such as an excavator, having a controlled arm mechanism and push blade.

At the heart of the present invention is inventor's discovery that the controlled arm mechanism found on many commonly used industrial vehicles offers the articulation required to instantly adjust the grading width when a variable width screed attachment is properly configured and fixed to the vehicle. By moving the control arm's radial position, the operator can instantaneously and precisely modify the grading width without suspending the grading operation. The variable nature of the control arm's radial adjustment allows the operator to fine tune the width of the screed along a spectrum of possible positions rather than a set of fixed widths.

The present invention is comprised of a stationary support guide having a face and an elongated beam having a box end, a free end, a longitudinal axis, and a cross-sectional area. In one embodiment, material is cut or otherwise removed from the face of the stationary support guide, creating a support cavity that corresponds with the general size and shape of the beam's cross-sectional area. The free end of the elongated beam is mounted within the support cavity, allowing the elongated beam to freely slide within that cavity along the beam's longitudinal axis. A screed box side is positioned near the box end of the elongated beam and transverse to the beam's longitudinal axis. The stationary support guide extends outward, transverse to the beam's longitudinal axis to form a second sidewall.

Industrial vehicles, such as excavators, are equipped with controlled arm mechanisms and push blades or backfill blades. The stationary support guide is securely fixed to the vehicle's push blade. The box end of the elongated beam is securely fixed to the controlled arm mechanism of that vehicle. Once the elongated beam and stationary support guide have been secured to the vehicle, the portion of the elongated beam between the box end and stationary support guide forms a screed. Together, the screed box side, screed, and stationary support guide form a screed box. The width of the screed box as well as its elevation above the ground is determined by the position of the controlled arm mechanism.

Radial movement of the controlled arm mechanism allows the box end of the elongated beam to move along the beam's longitudinal axis as it slides within the support cavity of the stationary support guide. At any given time, the grading width is governed by the distance between the stationary support guide and the box end of the elongated beam. The screed narrows as the box end of the elongated beam moves toward the stationary support guide.

Material in a grading area is generally graded to a desired thickness. Adjustable skid shoes may be mounted on the stationary support guide and screed box side to allow greater control over the grading depth. These skid shoes can be vertically adjusted to increase or decrease the screed's elevational position above the grading area. As the attachment moves over the work area, the adjustable skid shoes follow the contour of the earth and the elevation of the screed determines the amount of material that passes and levels beneath it.

Compression of the screed in the grading area is determined by the mass of the screed attachment coupled with the hydraulic pressure exerted on this attachment by the controlled arm mechanism. As previously discussed, the immense weight of commercial grading machines generally supplies the required pressure to compress and smooth the grading area. The hydraulic pressure exerted by the controlled arm mechanism in the present invention eliminates the need for such a massive machine and addresses the insufficient compression concerns raised by smaller grading attachments.

The instantaneously adjustable position of the box end of the elongated beam combined with the fixed position of the stationary support guide, allows the operator to fine tune the width of the screed box on a real-time basis in order to funnel and channel material where it is most needed. This eliminates the need to suspend the grading process while adjusting the grading width through independent controls or mechanical extension screeds. It also reduces rework time by minimizing overflow above and around the screed and reduces the amount of excess material deposited along the trench edges.

Because this device can be mounted to an industrial vehicle having a controlled arm mechanism and push blade, the need for a single purpose grader is eliminated. Workers can reduce the amount of machinery required at the jobsite thereby minimizing the purchase, repair, maintenance, and transportation costs associated with additional equipment.

Visibility and maneuverability are also improved with this device. The open nature of the attachment allows the operator to more readily monitor the work site and the smaller size of the equipment allows for easier repositioning. This results in a reduction of operational time and expense.

REFERENCE NUMERALS

10 Variable Width Screed Attachment
15 Elongated Beam Assembly
20 Screed Box Side
25 Bottom Edge of Screed Box Side
30 Elongated Beam
35 Upper Flange or Top of Elongated Beam

38 Cross-sectional Shape and Size of Elongated Beam
40 Longitudinal Axis of Elongated Beam
42 Web of Elongated Beam
44 Lower Flange or Bottom of Elongated Beam
45 Box End of Elongated Beam
50 Free End of Elongated Beam
55 Universal Connector
60 Screed Box Top
65 Stationary Support Guide
70 Bottom Edge of Stationary Support Guide
72 Support Guide Face
75 Stationary Support Cavity
80 Industrial Vehicle
85 Push Blade
88 Push Blade Eye
90 Controlled Arm Mechanism
95 Controlled Arm Connector
100 Distal End of Controlled Arm Mechanism
105 Pin
110 Socket
115 Tie
120 Reinforcing Beam or Plate
125 Adjustable Skid Shoe
130 Adjustable Skid Shoe Fastener
135 Rigidity Plate or Beam
140 Beam Support

DETAILED DESCRIPTION OF THE INVENTION

Figure 1:
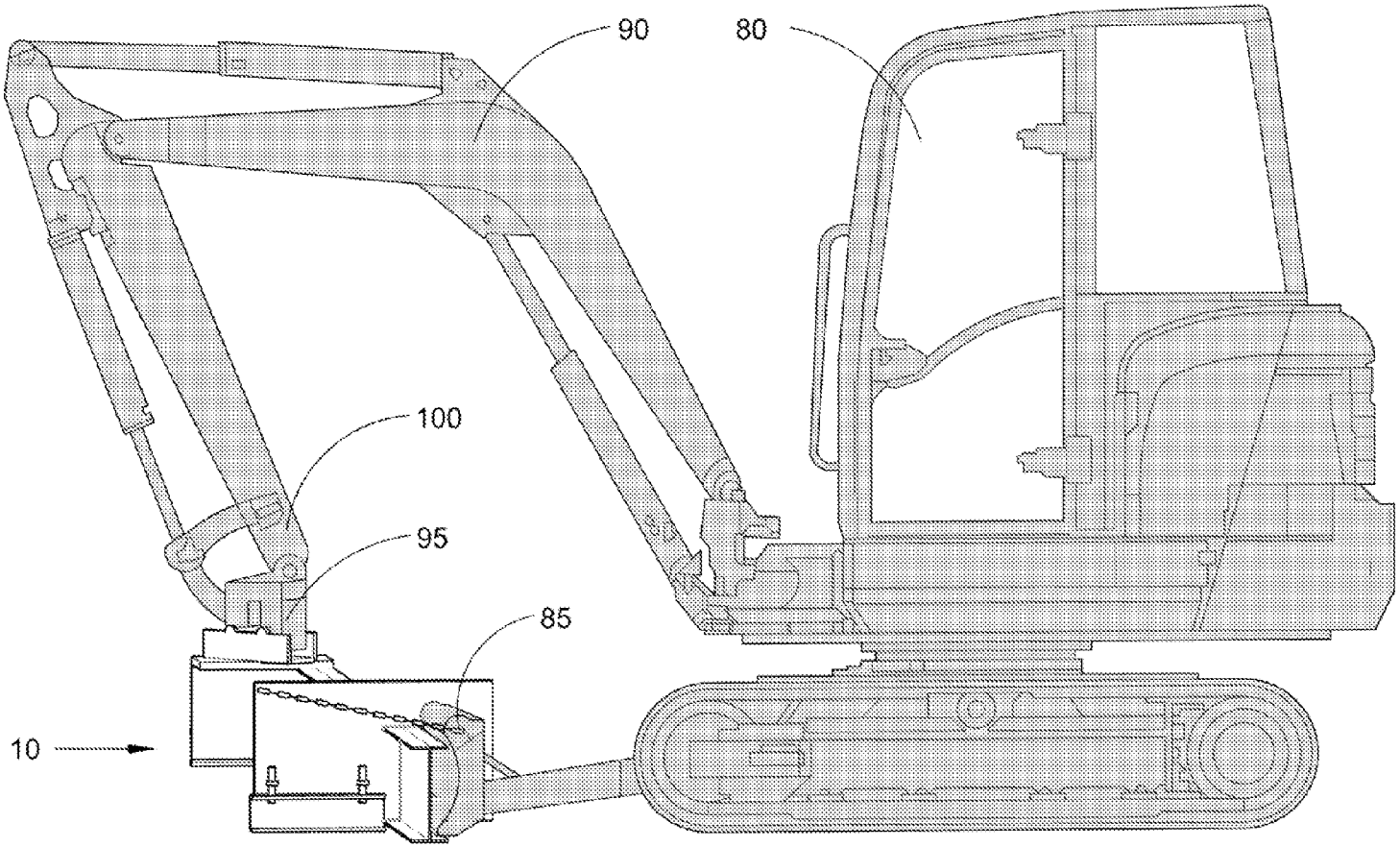
FIG. 1 is a perspective view of one embodiment of the present invention secured to the push blade and controlled arm mechanism of an industrial vehicle.

Referring now to FIGS. 1 through 9, the present invention provides a variable width screed attachment 10 for the leveling and grading of a variety of construction materials. One of the principal objects of the present invention is to provide a screed attachment 10 with a rapidly adjustable width that can be mounted to an industrial vehicle 80. Typically, an industrial vehicle 80 such as an excavator, skid loader or the like has a push blade 85 and can be equipped with a controlled arm mechanism 90 having a control arm connector 95 and a distal end 100. FIG. 1 depicts the screed attachment 10 mounted on the controlled arm mechanism 90 and push blade 85 of an excavator.

Figure 2:
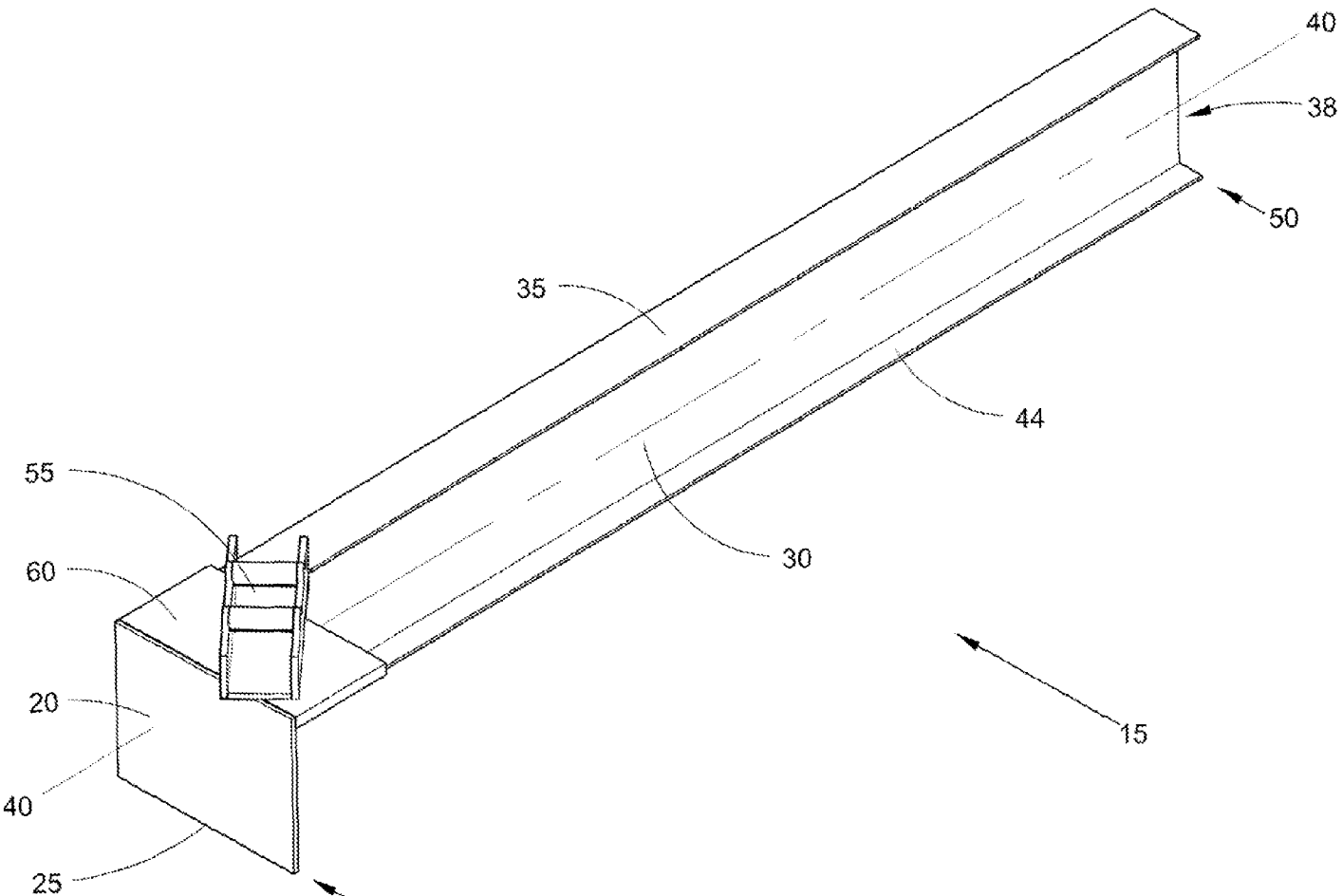
FIG. 2 is a perspective view depicting one embodiment of the elongated beam assembly.

In accordance with the present invention, the screed attachment 10 comprises an elongated beam assembly 15 as shown in FIG. 2 and a stationary support guide 65 illustrated in FIGS. 1, 3A, 3B, and 4 though 9.

Referring now to FIG. 2, the elongated beam assembly 15 includes a screed box side 20 having a bottom edge 25 and further comprises an elongated beam 30 having an upper flange or top 35, a cross-sectional shape and size 38, a lower flange or bottom 44, and a longitudinal axis 40 that is substantially parallel to the plane in which material is graded. The elongated beam 30 further includes a box end 45 and a free end 50. The screed box side 20 is positioned near the box end 45 of the elongated beam 30 transverse to the longitudinal axis 40. This screed box side 20 may be integral to the elongated beam 30 or may be a separate element that is secured to the elongated beam using a weld or other mechanical fixation means.

A universal connector 55 is positioned on the upper flange 35 of the elongated beam 30 or alternatively to the screed box side 20 of the elongated beam assembly 15. In the embodiment shown in FIG. 2, an optional screed box top 60 is affixed to the upper flange 35 of the elongated beam 30 to provide increased surface area for placement of the universal connector 55. The universal connector 55 may be positioned on the screed box top 60 as depicted in FIG. 2.

Figure 3A:
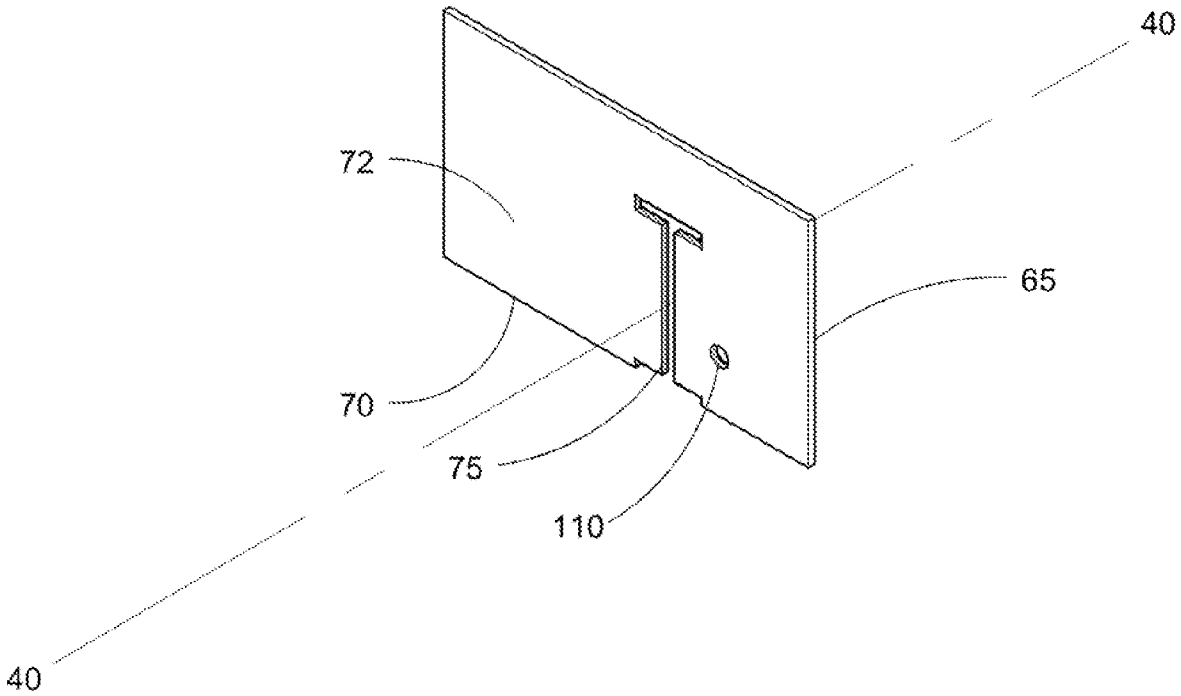
FIG. 3A is a perspective view of one embodiment of the stationary support guide having stationary support cavity accommodating an I-Beam.
Figure 3B:
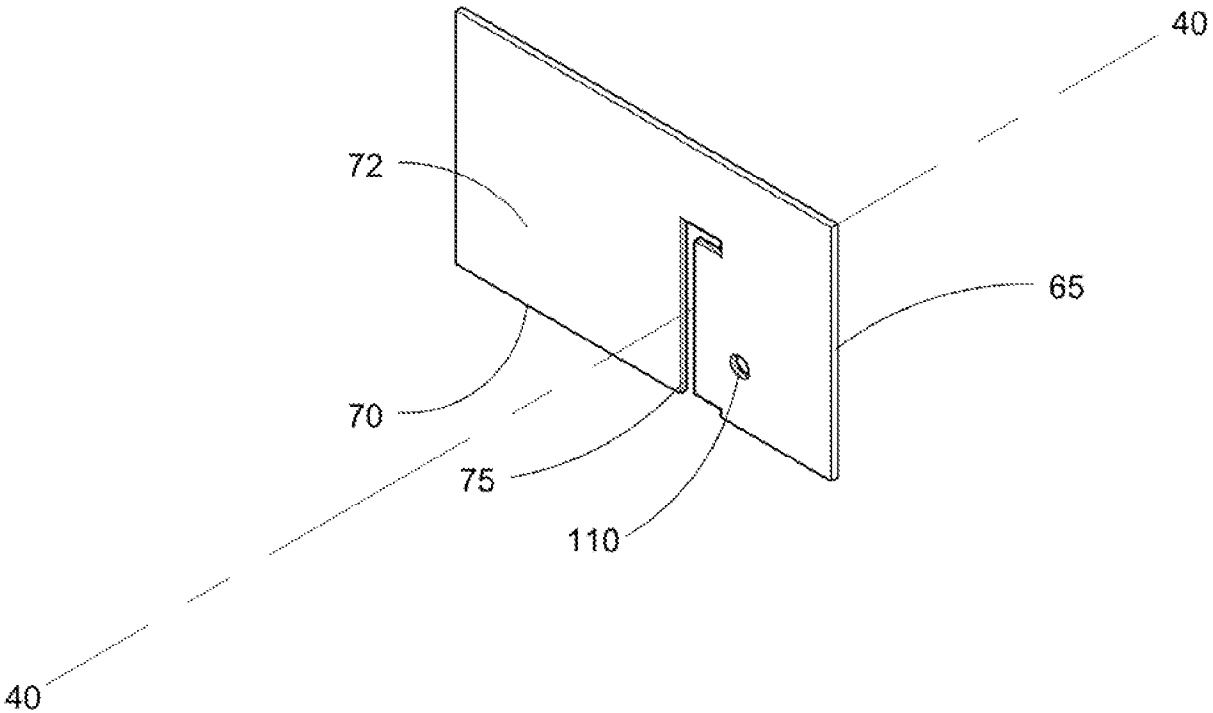
FIG. 3B is a perspective view of another embodiment of the stationary support guide having stationary support cavity accommodating a C-Beam.

Referring now to FIGS. 3A and 3B, the stationary support guide 65 comprises a bottom edge 70, a support guide face 72, and a stationary support cavity 75. In one embodiment, material is cut or otherwise removed from the support guide face 72 to create the stationary support cavity 75. The size and shape of the stationary support cavity 75 will vary with the cross-sectional size and shape 38 of the elongated beam 30 as illustrated in one embodiment depicted in FIG. 4. In order to prevent material from becoming lodged within the stationary support cavity 75 and potentially jamming the screed attachment, the size and shape of stationary support cavity 75 should closely approximate the size and shape of the beam cross section 38, allowing the elongated beam 30 to freely travel within the cavity 75 without an excess amount of play.

Referring now to FIGS. 4, 5 and 7 through 9, the free end 50 of the elongated beam 30 is mounted on the stationary support guide 65 and within the stationary support cavity 75 such that the elongated beam 30 can slide freely within the stationary support cavity 75 along the longitudinal axis 40. In the preferred embodiment, the stationary support guide 65 extends outward transverse to the longitudinal axis 40 of the elongated beam 30, forming a second sidewall as illustrated in FIGS. 4, 5 and 7 through 9.

Figure 4:
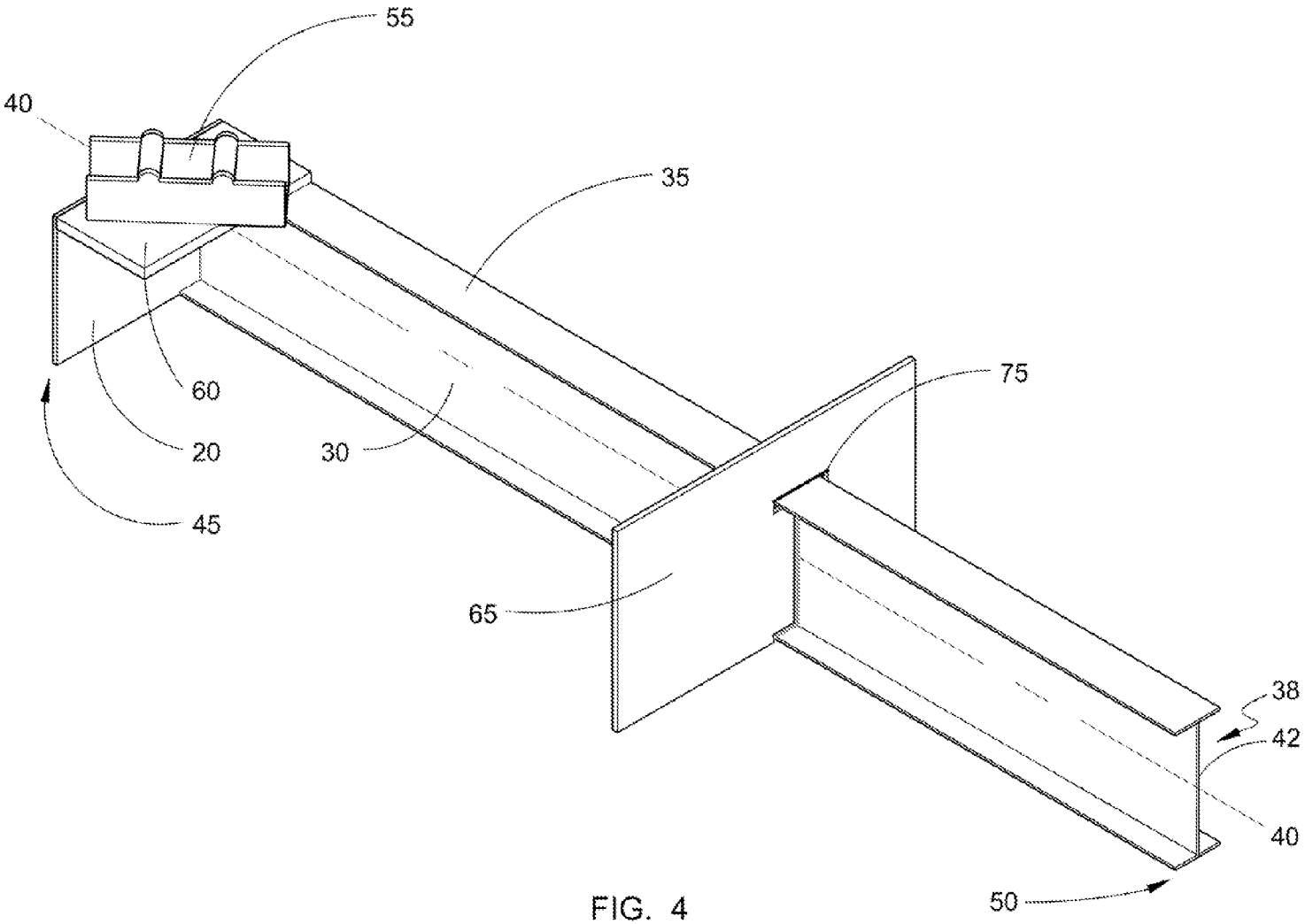
FIG. 4 is a perspective view of the elongated beam assembly mounted on the stationary support guide in one embodiment of the invention.
Figure 5:
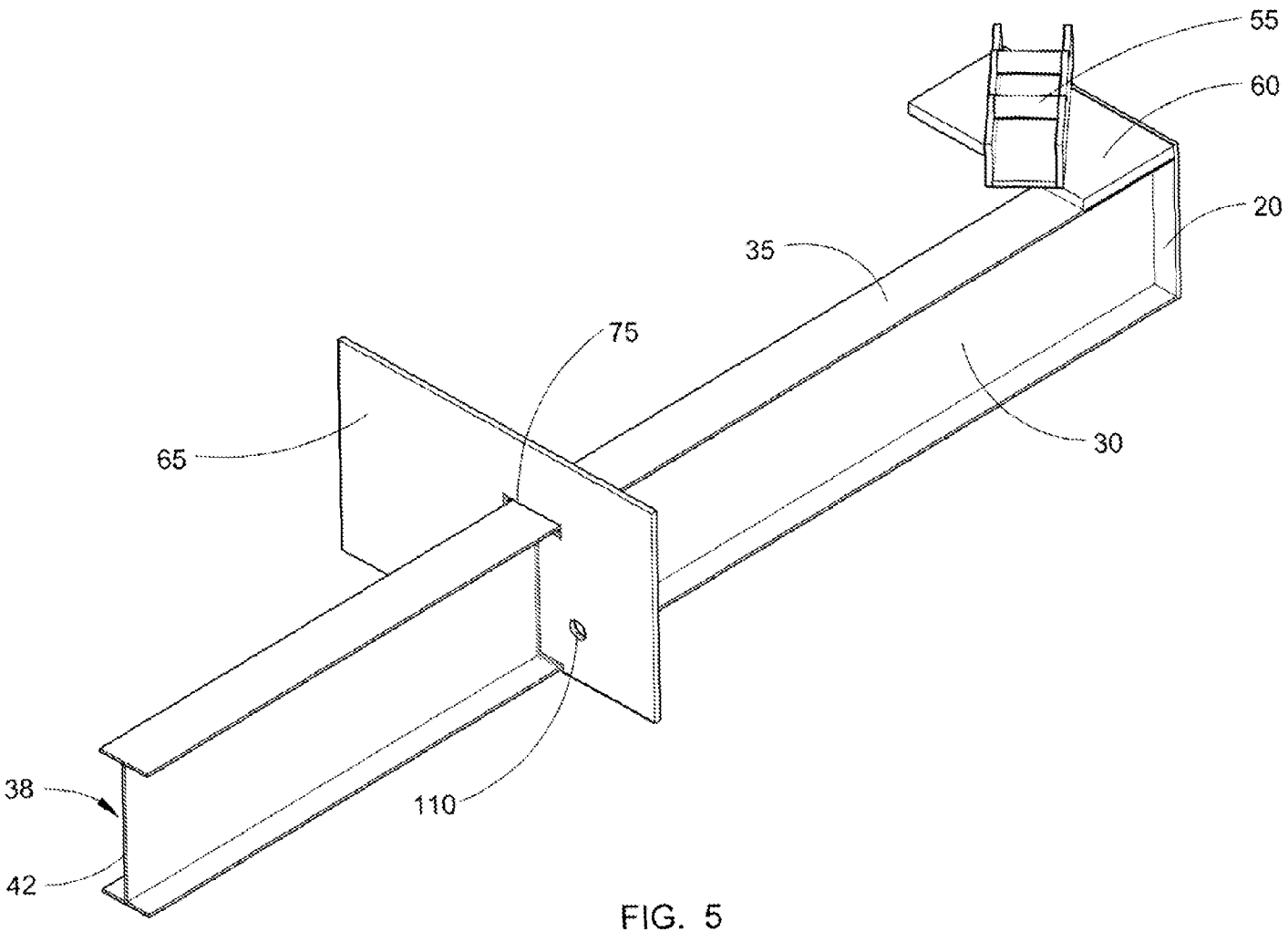
FIG. 5 is a perspective view depicting the rear of one embodiment of the invention.

The universal connector 55 secures the elongated beam assembly 15 to the controlled arm connector 95 located at the distal end 100 of the controlled arm mechanism 90 using a mechanical means such as a pin and bolt, quick coupler or similar fastening means. Inventor contemplates use of a releasable pin grabber quick coupler for the universal connector 55 as depicted in FIGS. 2, 4 and 5; however, the nature of the control arm connector 95 will vary with the make and model of the industrial vehicle 80. The mechanical configuration of the universal connector 55 for securing the controlled arm mechanism 90 will therefore vary with the type of control arm connector 95 on that industrial vehicle 80.

The push blade 85 of the industrial vehicle 80 is secured to the stationary support guide 65 using a mechanical fastening means such as a pin and socket, pintle and gudgeon, swivel pin, slide pin or similar fastening means. Referring now to FIGS. 3A, 3B, 5 and 8, in one embodiment inventor contemplates the use of a pin 105 placed through a socket 110 on the stationary support guide 65. This socket 110 is aligned with a cavity or eye 88 in the push blade 85 of the industrial vehicle 80 and secured with the pin 105. Because the configuration of the push blade 85 will vary with the make and model of the industrial vehicle 80, a variety of mechanical fastening means may be adapted to secure the push blade 85 to the stationary support guide 65. In order to prevent excess wear and tear on this fastening means, the connection should offer a slight degree of play, allowing the screed attachment some freedom of movement as it follows the contour of the earth.

Once the present invention is securely attached to the industrial vehicle 80, the width of the screed box, and thus the grading width, can be modified. Radial movement of the controlled arm mechanism 90 will determine the position of the box end 45 of the elongated beam 30. Grading width is narrowed by moving the box end 45 of the elongated beam 30 toward the stationary support guide 65. Grading width is widened by moving the box end 45 of the elongated beam 30 away from the stationary support guide 65. The familiar movement of the controlled arm mechanism 90 available in many industrial vehicles allows the vehicle operators to modify the width of the grading area along a range of possible positions virtually instantaneously.

The compaction thickness of the graded material can be adjusted through the addition of a metal plate, beam, or edge with an adjustable height. These adjustable beams or plates are often referred to as skis, skids or skid shoes and are used both to set the compaction thickness of the material being graded and to reduce wear on the elongated beam 30, screed box side 20 and stationary support guide 65. Adjustable skid shoes 125 engage with the earth's surface and follow the contour of the terrain beneath the grading area, allowing material to flow, level, and compact beneath the elongated beam 30. The height at which these skid shoes 125 are fixed determines the depth of material that flows beneath the elongated beam 30.

Figure 7:
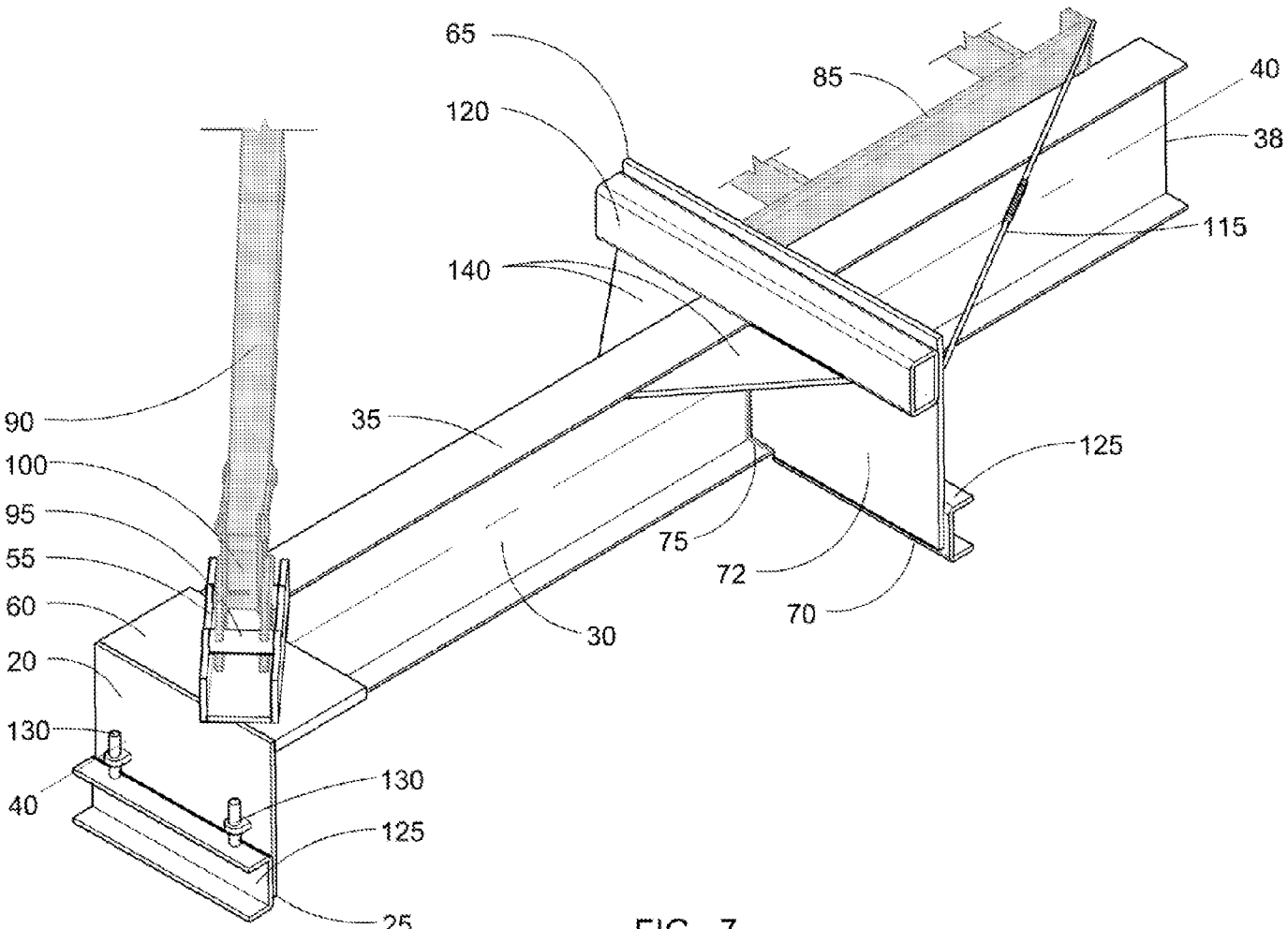
FIG. 7 is a perspective view illustrating the front of another embodiment of the invention having adjustable skid shoes, beams supports and a reinforcing beam, the invention being secured to controlled arm mechanism and push blade of an industrial vehicle.
Figure 8:
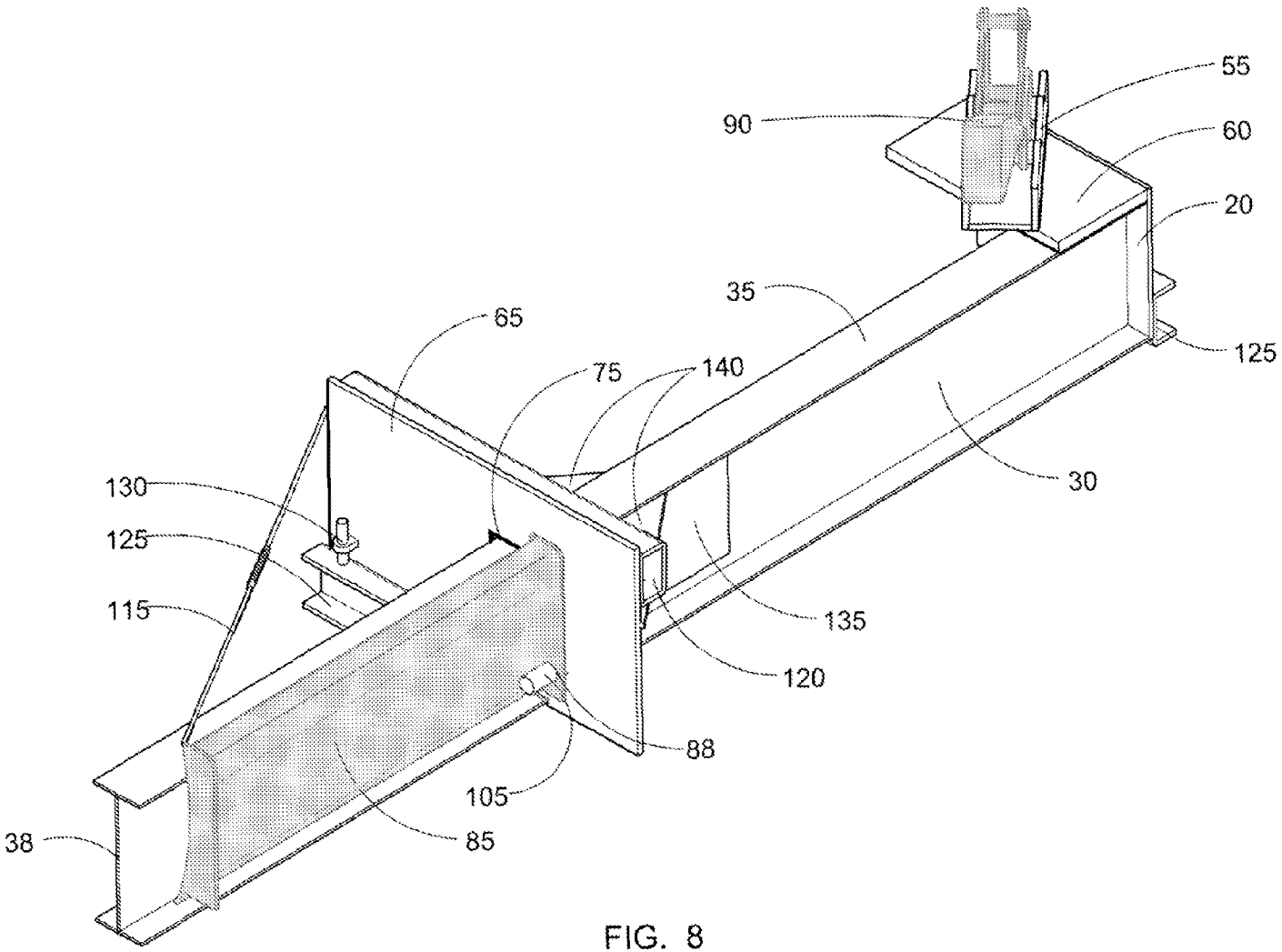
FIG. 8 is a perspective view illustrating the rear of another embodiment of the invention secured to the controlled arm mechanism and push blade of an industrial vehicle.
Figure 9:
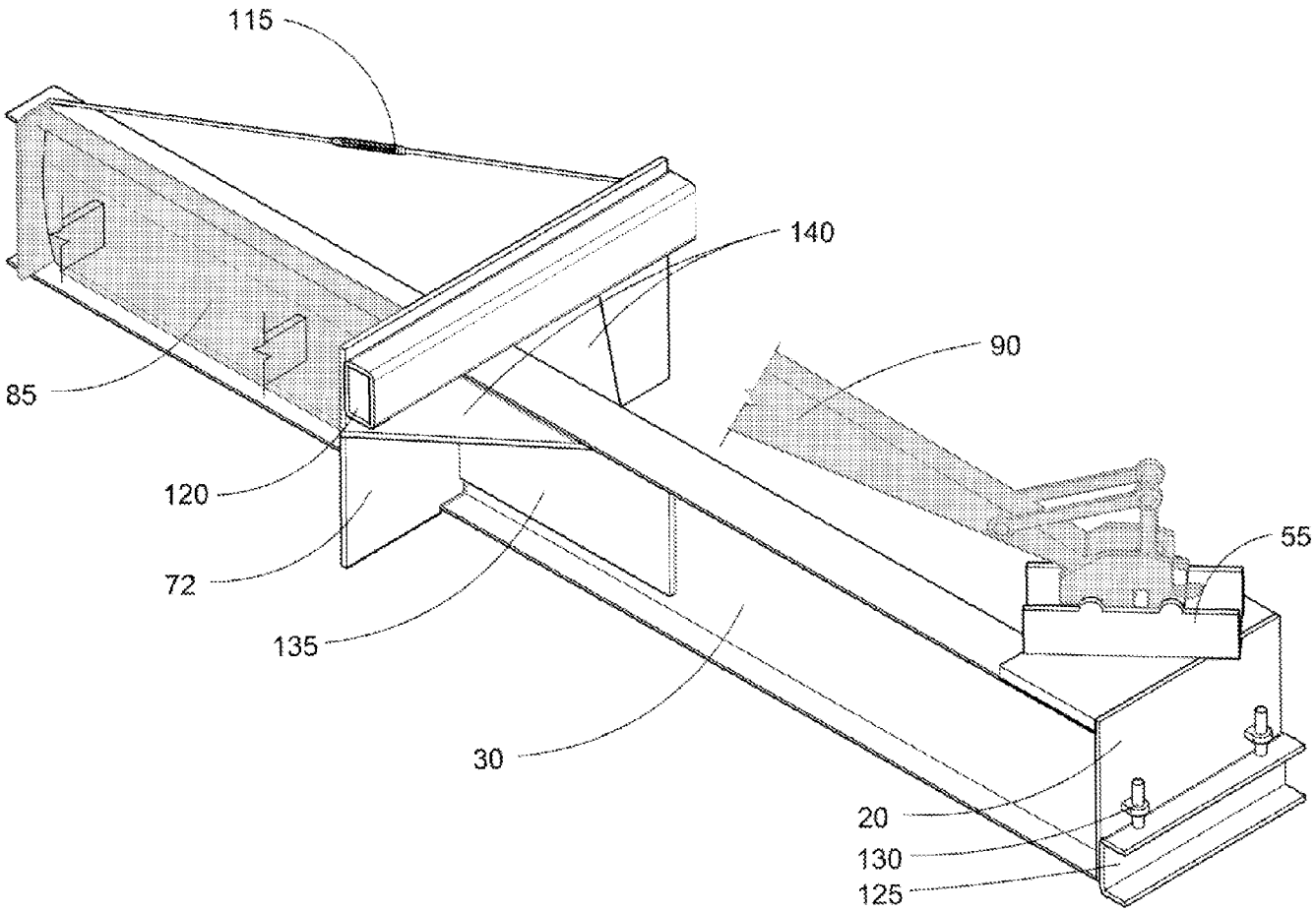
FIG. 9 is a perspective view illustrating the rear of the invention secured to the controlled arm mechanism and push blade of an industrial vehicle and more clearly depicting the rigidity plate and beam supports used in one embodiment.

Referring now to FIGS. 7 through 9, adjustable skid shoes 125 are fastened adjacent to the bottom edge 25 of the screed box side 20 and the bottom edge 70 of the stationary support guide 65 using adjustable skid shoe fasteners 130. The adjustable skid shoes 125 are positioned such that they are outside the grading area as depicted in FIG. 7. A variety of adjustable fastening means 130 can be used to vary and fix the height of these skid shoes 125. Such means include but are not limited to configurations using pins and sockets, bolts and slotted holes, or threaded rods and nuts.

The elongated beam 30 will be more easily supported within the stationary support cavity 75 if the beam 30 has an upper flange 35; however, the stationary support cavity 75 may be configured to accommodate a multitude of cross sectional shapes and sizes. FIG. 3A depicts one embodiment having a substantially I-shaped stationary support cavity 75 capable of accommodating an I-beam having an upper flange 35, a web 42, and lower flange 44. FIG. 3B illustrates another embodiment having a substantially C-shaped stationary support cavity 75 capable of accommodating a C-beam.

Inventor contemplates the use of a steel stationary support guide 65 having a thickness of 0.375 inches and a steel elongated I-beam 30 that is eight feet in length and of the W14×22 type; however, these components may be made of any material and dimensions of suitable strength and rigidity to withstand the forces exerted on them during the grading process.

If the stationary support guide 65 flexes excessively, the stationary support cavity 75 may deform and compress the elongated beam 30. This deformation may hinder movement of the elongated beam 30 within the stationary support cavity 75. Deformation of the stationary support cavity 75 can be avoided by increasing the thickness of the stationary support guide 65 or alternatively, by reinforcing it. Referring now to FIGS. 6 through 9, the rigidity of the stationary support guide 65 is fortified through the addition of one or more reinforcing beams or plates 120 in one embodiment. The reinforcing beam 120 is mechanically affixed to the stationary support guide 65 in such a manner that it will not interfere with material in the grading area. The reinforcing beam 120 may be hollow or solid and may have a variety of cross-sectional shapes and sizes depending on the amount of reinforcement desired.

Referring again to FIGS. 7 through 9, one or more ties 115 may be used in combination with or in lieu of a reinforcing beam 120 as a means of reinforcing the stationary support guide 65. One end of the tie 115 is mechanically affixed to the push blade 85 of the industrial vehicle 80 while the other end is mechanically affixed to the stationary support guide 65. Ties 115 may be comprised of one or more chains as shown in FIG. 1, guy wires, or cables as shown in FIGS. 7 through 9. Each tie 115 should be fairly taught in order to prevent flexing of the stationary support guide 65 but should offer enough slack or suitable tensile strength to accommodate the forces exerted on it without excessive strain as the stationary support guide 65 follows the contour of the terrain in the grading area.

Figure 6:
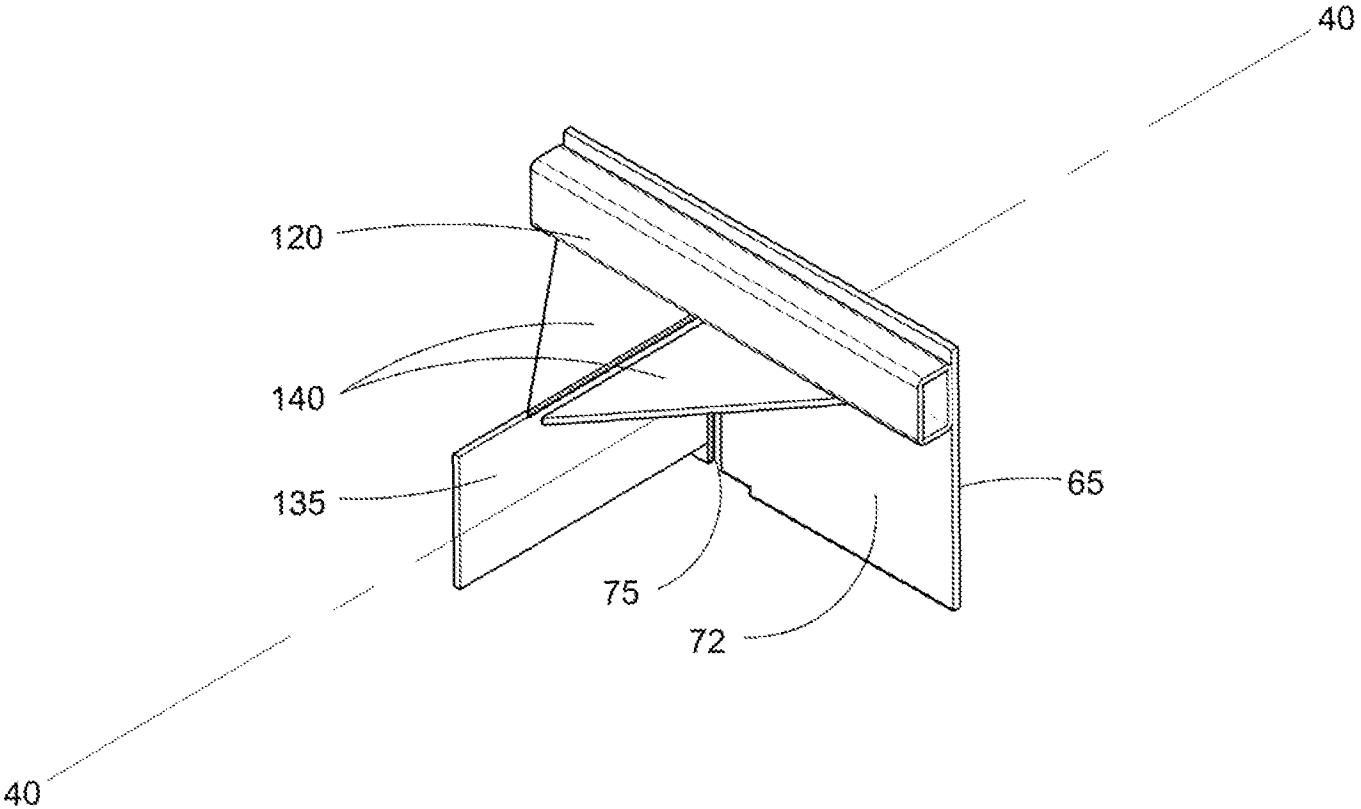
FIG. 6 is a perspective view of the stationary support guide, reinforcing beam, beam supports and rigidity plate used in another embodiment of the invention.

If the elongated beam 30 flexes excessively, it may pinch within the stationary support cavity 75, slowing or inhibiting adjustment of the screed width. This can be avoided by selecting a beam size and shape that offers the rigidity required to withstand the forces exerted on it without substantial deflection. Alternatively, a rigidity plate or beam 135 may be mechanically affixed to the stationary support guide as shown in FIG. 6. In one embodiment, this rigidity plate 135 is positioned adjacent to the web 42 of the elongated beam 30 along the longitudinal axis 40 and prevents excessive deflection of the elongated beam 30 during the grading process. Ideally, the rigidity plate 135 is positioned behind the elongated beam 30, outside of the grading area as shown in FIGS. 8 and 9, to prevent material from lodging within it.

While the geometry of the stationary support cavity 75 provides support of the elongated beam, support of this beam may be enhanced through the use of one or more beam supports 140 mounted beneath the upper flange or top 35 of the elongated beam 30. FIG. 6 illustrates one embodiment using two beam supports 140, mechanically affixed to the stationary support guide 65. As depicted in FIGS. 7 through 9, these beam supports 140 are mounted beneath the upper flange 35 of the elongated beam 30 and improve support of the beam 30 by distributing its weight. In the embodiment shown, triangular beam supports 140 are utilized, however, a variety of shapes and sizes can be used.

In accordance with the discussion above, reader will note that at least one embodiment of the screed attachment provides a more cost effective, easily maneuverable grading device that offers sufficient compression to successfully grade the work area to a desired thickness. The invention further provides virtually instantaneous adjustment of the grading area along a wide range of widths, minimizing the time required to grade the work area.

While the above description contains many specifics, these should be considered exemplifications of one more embodiments rather than limitations on the scope of the invention. As previously discussed, many variations are possible and the scope of the invention should be determined by the appended claims and their legal equivalents rather than the examples provided.

What is claimed is:

1. A variable width screed attachment mounted on an industrial vehicle having a controlled arm mechanism and a push blade, the attachment comprising:

an elongated beam having a longitudinal axis and a box end, wherein the box end of the elongated beam is secured to the controlled arm mechanism of the industrial vehicle; and a stationary support guide fixedly secured to the push blade of the industrial vehicle and slidably connected to the elongated beam such that the elongated beam can travel with respect to the stationary support guide along the longitudinal axis of said elongated beam.

2. The screed attachment according to claim 1, wherein the box end of the elongated beam and the stationary support guide each have a bottom edge, the attachment further comprising one or more ground engaging adjustable skid shoes securely mounted near the bottom edge of the box end of the elongated beam and the bottom edge of the stationary support guide.

3. A variable width screed attachment mounted on an industrial vehicle having a controlled arm mechanism and push blade, the attachment comprising:

an elongated beam having a longitudinal axis, a box end, and a screed box side, wherein the box end of the elongated beam is secured to the controlled arm mechanism of the industrial vehicle and the screed box side is adjacent to the box end of the elongated beam and transverse to the longitudinal axis of said elongated beam; and a stationary support guide fixedly secured to the push blade of the industrial vehicle and slidably connected to the elongated beam such that the elongated beam can travel with respect to the stationary support guide along the longitudinal axis of said elongated beam.

4. The screed attachment according to claim 3, wherein the screed box side and the stationary support guide each have a bottom edge, the attachment further comprising:

a ground engaging adjustable skid shoe securely mounted near the bottom edge of the screed box side; and a second ground engaging adjustable skid shoe securely mounted near the bottom edge of the stationary support guide.

5. The screed attachment according to claim 3, wherein the stationary support guide has a face, the elongated beam has an upper flange and a web, and the slidable connection is a support cavity within the stationary support guide face accommodating the upper flange and web of the elongated beam, the attachment further comprising at least one beam support secured to the stationary support guide and mounted beneath the upper flange.

6. The screed attachment according to claim 3, wherein the stationary support guide has a face, the elongated beam has an upper flange and a web, and the slidable connection is a support cavity within the stationary support guide face accommodating the upper flange and web of the elongated beam, the attachment further comprising at least one rigidity plate secured to the stationary support guide and substantially perpendicular to the stationary support guide face and mounted adjacent to the web of the elongated beam.

7. The screed attachment according to claim 3, wherein the stationary support guide has a face and at least one reinforcing beam is affixed to the face of the stationary support guide.

8. The screed attachment according to claim 3, wherein the elongated beam is secured to the controlled arm mechanism of the industrial vehicle using a quick release mechanism.

9. The screed attachment according to claim 3, further comprising a tie securing the stationary support guide to the push blade of the industrial vehicle in a manner that limits flexing of the stationary support guide.

10. The screed attachment according to claim 3, wherein the stationary support guide has a face, the elongated beam is an I-beam having an upper flange, a web and lower flange, and the slidable connection is a substantially I-shaped support cavity within the stationary support guide face.

11. The screed attachment according to claim 3, wherein the stationary support guide has a face, the elongated beam is a C-beam having an upper flange, a web, and a lower flange, and the slidable connection is a substantially C-shaped support cavity within the stationary support guide face.

12. A variable width screed attachment mounted on an industrial vehicle having a controlled arm mechanism and push blade, the attachment comprising:

an elongated I-beam secured to the controlled arm mechanism of the industrial vehicle and having a longitudinal axis, a box end, an upper flange, a web, and a lower flange;

a stationary support guide having a face and a bottom edge, the stationary support guide being fixedly secured to the push blade of the industrial vehicle and slidably connected to the elongated beam such that the elongated beam can travel with respect to the stationary support guide along the longitudinal axis of said elongated beam;

a screed box side adjacent to the box end of the elongated beam and transverse to the longitudinal axis of said elongated beam, the screed box side having a bottom edge;

a ground engaging adjustable skid shoe securely mounted near the bottom edge of the screed box guide;

a second ground engaging adjustable skid shoe securely mounted near the bottom edge of the stationary support guide;

at least one beam support secured to the stationary support guide face and mounted beneath the upper flange;

at least one rigidity plate secured to the stationary support guide and substantially perpendicular to the stationary support guide face and mounted adjacent to the web of the elongated beam;

at least one tie securing the stationary support guide to the push blade of the industrial vehicle in a manner that limits flexing of the stationary support guide; and at least one reinforcing beam secured to the stationary support guide;

wherein the slidable connection is a substantially I-shaped support cavity within the stationary support guide face accommodating the upper flange, web, and lower flange of the elongated I-Beam.

* * * * *